United States Patent [19]

Creighton

[11] 4,017,953

[45] Apr. 19, 1977

[54] HEAT EXCHANGERS

[75] Inventor: Gordon Robert Creighton, Cambridge, England

[73] Assignee: Ciba-Geigy Corporation, Ardsley, N.Y.

[22] Filed: Apr. 9, 1975

[21] Appl. No.: 566,567

[30] Foreign Application Priority Data

Apr. 11, 1974 United Kingdom ..... 16126/74

[52] U.S. Cl. ..... 29/157.3 V; 165/167

[51] Int. Cl.[2] ..... B23P 15/26

[58] Field of Search ..... 29/157.3 R, 157.3 V; 165/167, 157.3 V

[56] References Cited

UNITED STATES PATENTS

| | | | |
|---|---|---|---|
| 2,617,634 | 11/1952 | Jendrassik | 29/157.3 R |
| 2,759,246 | 8/1956 | Campbell | 29/157.3 V |
| 2,766,514 | 10/1956 | Adams | 29/157.3 V |
| 2,884,768 | 5/1959 | Gould | 29/157.3 V |
| 2,896,312 | 7/1959 | Schell | 29/157.3 V |
| 2,999,306 | 9/1961 | Baxter | 29/157.3 V |
| 3,111,747 | 11/1963 | Johnson | 29/157.3 V |
| 3,214,949 | 11/1965 | Johnson | 29/157.3 V |
| 3,763,681 | 10/1973 | Flintoft | 29/157.3 V |

FOREIGN PATENTS OR APPLICATIONS

| | | | |
|---|---|---|---|
| 604,225 | 8/1960 | Canada | 29/157.3 V |
| 602,644 | 8/1960 | Canada | 29/157.3 V |
| 786,608 | 11/1957 | United Kingdom | 29/157.3 V |

*Primary Examiner*—C.W. Lanham
*Assistant Examiner*—V. Rising
*Attorney, Agent, or Firm*—Harry Falber

[57] ABSTRACT

A method of making a heat exchanger consisting of a conduit having a plurality of passes joined by integral return bends which comprises i. stacking at least three pairs of strips of material together so that each pair of strips is displaced laterally with respect to an adjacent pair of strips, ii. bonding the strips together to form a flat, serpentine conduit, and iii. inflating the conduit by applying internally a fluid under pressure.

14 Claims, 14 Drawing Figures

HEAT EXCHANGERS

This invention relates to a new method for the manufacture of heat exchangers and to heat exchangers made by the new method.

Heat exchangers comprising top and bottom tanks connected by a series of metal tubes through which a heating or cooling fluid passes are well known. Such heat exchangers are expensive to manufacture because they comprise a number of shaped tubes, each of which must be fitted into holes in the top and bottom tanks and sealed into place. It is also known, in the manufacture of these heat exchangers, to form the tubes by applying adhesive to thin, appropriately shaped metallic pieces and abutting the pieces together with pressure to effect bonding. This process requires careful control, since unless the manufacture of the pieces is carried out to within very close tolerances, uneven pressing will occur which can cause misalignment and even imperfect seals.

It is further known, from British Pat. Nos. 770,296 and 1,167,090, to manufacture heat exchangers from thin metallic strips by a process in which the edges of the strips are bonded together along their length, the pairs of strips are bent into a serpentine configuration, and they are inflated by means of a fluid pressure internally applied. Such a method suffers from at least one serious drawback. In order to ensure that an open passage is obtained at the bends, uninflated joined pairs of strips are bent around curved formers, but the resultant stack cannot then be compressed. The uninflated stack is therefore comparatively bulky, and its storage and transportation is less of a practical proposition.

There has now been discovered a method, by which these difficulties may be at least substantially overcome, in which the strips have integral return bends in the uninflated condition: in this state they may be stored and transported and then inflated when required.

In this new method at least six strips of material are stacked and bonded together, usually under pressure, to form a flat serpentine conduit and, when desired, they are inflated by the ingress of a fluid (such as air or water) under pressure to form a heat exchanger matrix in which, by means of integral return bends, it is ensured that an open passage is obtained at these bends without the need to take special precautions.

In accordance with the present invention therefore, there is provided a method of making a heat exchanger consisting of a conduit having a plurality of passes joined by integral return bends which comprises i. stacking at least three pairs of strips of material together so that each pair of strips is displaced laterally with respect to an adjacent pair of strips,
ii. bonding the strips together to form a flat, serpentine conduit, and
iii. inflating the conduit by applying internally a fluid under pressure.

Usually, but not necessarily, the passes in the inflated conduits are parallel; other configurations, such as curved or sinusoidal passes, may also be adopted.

Materials used to make the new heat exchange must be inert to attack by the heat exchange medium and to the fluid used in the inflation, and also sufficiently pliable, with heating if required, to deform and inflate when subjected to the internal pressure. Suitable materials may be metallic or non-metallic and include copper, mild steel, aluminum alloy, and the following thermoplastic resins: poly(phenylene oxides), poly(phenylene sulphides), polysulphones, polyimides, and phenoxy resins. Metal strips, especially of aluminum or aluminum alloy, are preferred. Preferably, too, the strips are from 0.01 mm to 0.8 mm, and especially from 0.05 to 0.35 mm, thick, so as tobe readily deformable on inflation.

The strips may be bonded together either by means of a suitable adhesive, particularly a thermosetting resin adhesive composition, or, if they are metallic, by welding, soldering, or brazing. In any case the strips must be joined continuously in a pattern which leaves one or more unbonded areas to be inflated. When an adhesive is used, this is, of course, applied only to those parts which it is desired should be bonded together. However, when the strips are bonded by welding, soldering, or brazing, a release agent or stop-weld is usually applied to those areas which will be inflated to form the channels in the conduit.

As already indicated, any adhesive used must be resistant to the conditions under which the heat exchanger will be employed. For example, if the heat exchanger is to be used as a radiator in a water--cooled internal combustion engine of a motor vehicle, the adhesive must be resistant to hot water containing ethylene glycol or other anti-freeze component. The adhesive may be thermosetting, elastomeric, or thermoplastic, thermosetting adhesives being, as already indicated, preferred. It is an advantage of the method now provided that adhesives may be employed which require a heavy pressure to cause them to flow and adhere effectively: such adhesives could not be employed in previously known methods for making heat exchangers because of the risk of causing distortion at the bends. Typical suitable thermosetting adhesives are epoxide resins and phenolic resins, including phenolic resins containing an elastomer (such as a nitrile rubber) or a thermoplast (such as nylon or a vinyl polymer). Suitable elastomeric adhesives are natural or synthetic rubbers such as chlorinated rubbers, nitrile rubbers, and polysulphide rubbers. Suitable thermoplastic adhesive include poly(vinyl acetate), poly(vinyl chloride), polyacrylates, and polyamides.

The adhesive or release agent is applied before the strips are stacked. In forming the conduit, pressure is usually applied to the stack to assist bonding. Heat may also be applied at the same time, to cure a thermosettable resin employed as the adhesive or to weld, solder, or braze the strips together. It is sometimes advantageous, before applying pressure, to insert packing pieces between each pair of passes in the areas of the return bends, each packing piece having substantially twice the thickness of the strips: in the area of the bends there is only half the total thickness of material that there is in the centre of the stack, and by inserting the packing pieces the thicknesses are equalised and the pressure is thereby made even throughout, thus ensuring better adhesion. Conveniently, the packing pieces are taken from material of the same thickness as that constituting the strips and bent double before insertion. After the stack has been compressed and bonding has taken place, these packing pieces may be removed. A preferred method of providing packing pieces is to provide excess material at the end of each strip which is folded over prior to being stacked. Such packing pieces may be trimmed off but are usually allowed to remain in position after bonding has taken place.

In their simplest form, the heat exchangers have only one channel. However, more complex heat exchangers can be made by having a series of lines of bonding which divide the conduit into at least two separate channels, or if desired, at least two interconnecting channels may be made by having inner discontinuous lines of bonding on the strip. These channels need not be straight but may form a circuitous path within each pass of the conduit.

It is also within the scope of the present invention to cut a stack of conduit into any required length or, where the stack comprises a series of channels, into the number of narrower conduits and, if necessary, to inflate these separately. In this way a manufacturer is enabled to make a heat exchanger of practically any smaller, required size from a standard stack of bonded material.

Inflating the conduit by means of gaseous or liquid fluid pressure is preferably carried out after shaped tool pieces have been inserted between layers of conduit and the stack has been constrained within a frame and has been fitted between tie bars.

Before or after inflation, finning pieces are preferably inserted between passes of conduit to increase the surface area of the heat exchanger. Such pieces are usually made of the same materials as the conduit and may be fixed in position as by an adhesive. However, when the finning pieces are inserted before inflation of the stack, it is usually unnecessary to bond them in place; expansion of the passes of the heat exchanger usually provides sufficient grip to hold the finning pieces in place.

Completed heat exchangers may, if desired, be provided with a coating to protect them against corrosion due to the atmosphere or other external influences as well as to serve as an adhesive for finning pieces. Such coatings are conveniently applied by dipping into an organic coating medium which may contain metallic particles.

The process of this invention is illustrated by way of Example in the accompanying drawings.

FIGS. 1*a* to 1*g* show plan views of strips treated with adhesive or release agent prior to being stacked. Where an adhesive is used the symbol 10 denotes that adhesive and 11 denotes untreated material, while where welding is employed 10 denotes untreated metal and 11 denotes metal treated with a release agent.

FIG. 1*a* shows a strip which is adhered to the next strip along three sides (type A) while FIG. 1*b* shows a strip which is adhered to the next strip along one side (type B).

The lines AA′ and BB′ denote folds which may be made prior to effecting adhesion in order to ensure that pressure is applied evenly to the stack.

FIG. 1*c* and 1*d* show strips of types A and B, respectively, which form a multichannel heat exchange when stacked and adhered.

FIG. 1*e* shows a type A strip which, when combined with a type B strip scuh as is shown in FIG. 1*d*, forms a multichannel heat exchanger in which some of the channels are interconnected.

FIG. 1*f* shows a type A strip which, when combined with a type B strip such as is shown in FIG. 1*d*, forms a heat exchanger in which the fluid used for heating or cooling takes a circuitous path along each pass.

FIG. 1*g* shows a pair of strips which have no allowance of material for folds.

FIG. 2 shows an exploded view of a stack of strips, prior to their being adhered together. Each pair of strips, of types A and B, is placed in a staggered arrangement with an adjacent pair of strips. They are also arranged so that the lateral position of the adhesive alternates from one pair of strips to the next. For clarity in this figure the strips have not been shown folded along the lines AA′ and BB′ shown in FIGS. 1*a* to 1*f*. Type A strips are denoted by 21 and type B by 22.

Figure 5:
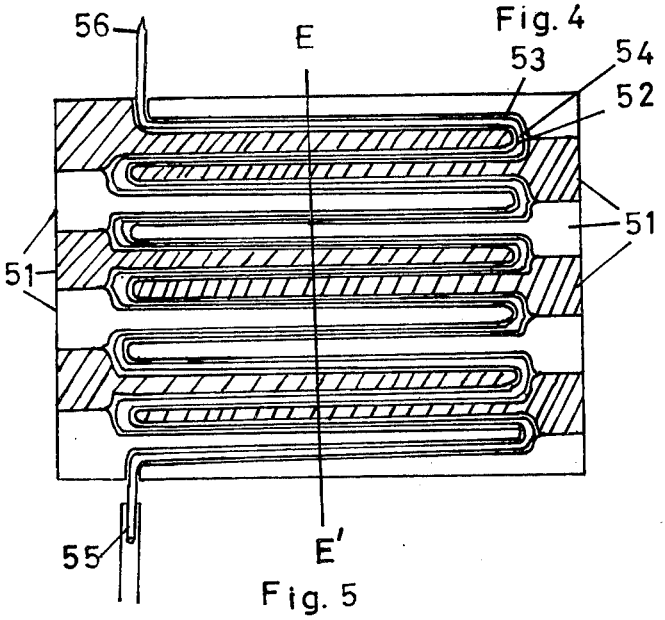

FIG. 5 shows a cross-section through a conduit stack after inflation. Strips 52 and 53 form a conduit having a continuous channel 54 running its entire length. Shaped tool pieces 51 are in position between each pass of the conduit. One end 55 of the conduit is connected to a source of fluid pressure (not shown) and the other end 56 is sealed. In an alternative arrangement, both ends 55 and 56 are connected to the source of fluid pressure.

Figure 5A:
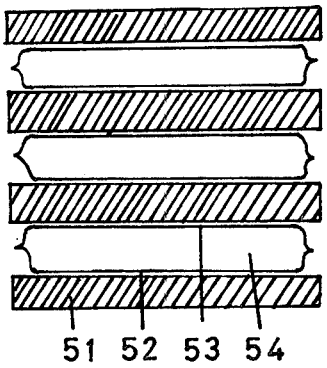

FIG. 5*a* shows a cross-section taken along the line EE′ illustrated in FIG. 5 when a single channel is formed.

Figure 5B:
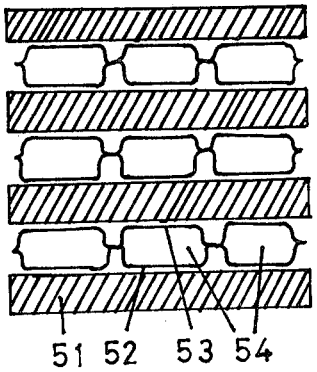

FIG. 5*b* shows a similar cross-section of a multichannel conduit.

Figure 6:
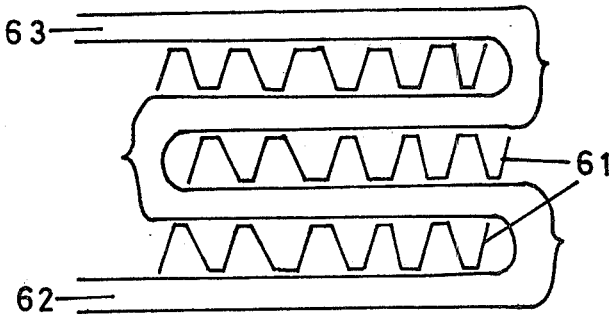

FIG. 6 shows a cross-section of a completed heat exchanger made in accordance with the present invention. Finning pieces 61 are positioned between each pass of the conduit and the ends 62 and 63 of the conduit are open to allow connection to the source (not shown) of the heat exchanger liquid.

The following Example illustrates the invention. All parts, unless otherwise specified, are by weight.

EXAMPLE

Figure 1A:
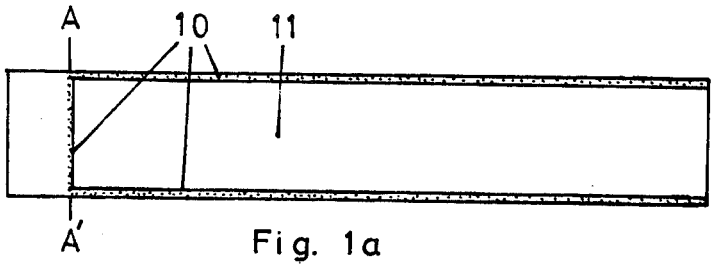
Figure 1B:
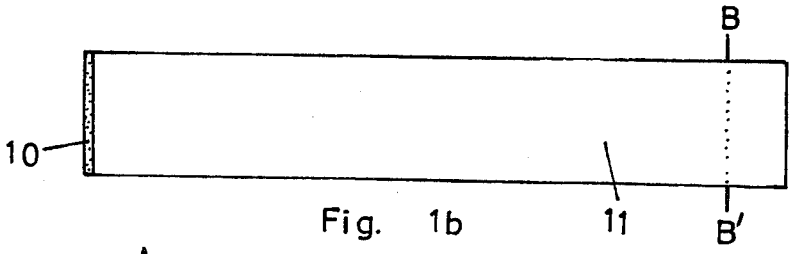
Figure 1C:
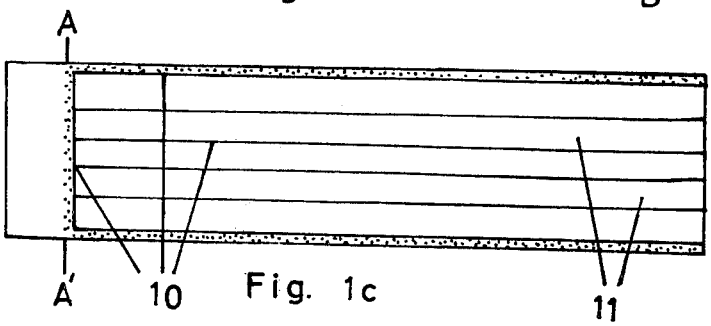
Figure 1D:
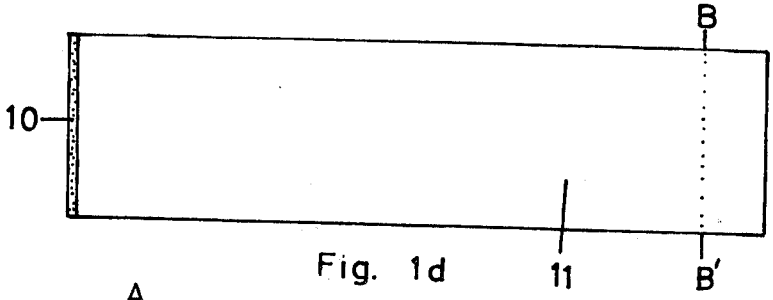
Figure 1E:
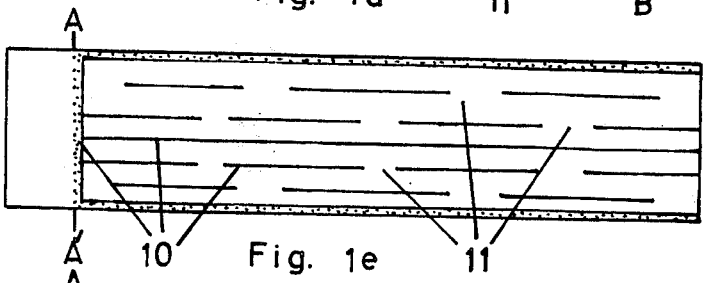
Figure 1F:
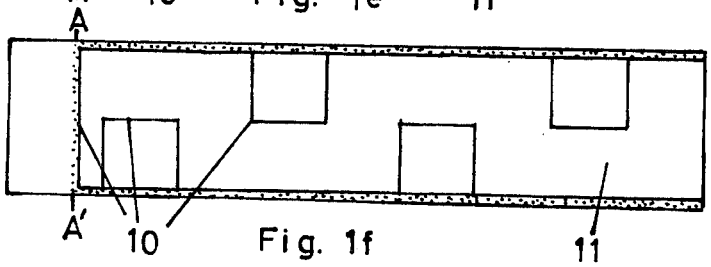
Figure 1G:
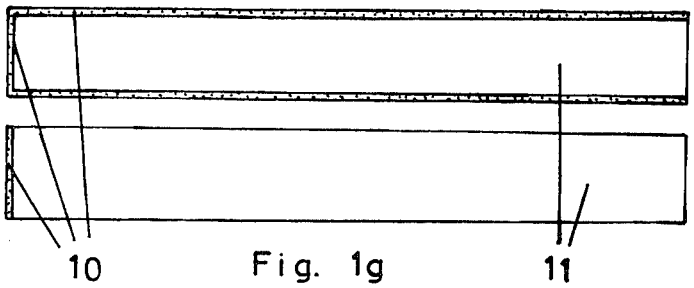

Strips of 'Alcan 2S' aluminum foil in the annealed condition, 0.1 mm thick and 63.5 mm wide and 500 mm long, were printed on one side with lines of adhesive 6.5 mm wide, some in the manner shown in FIG. 1*a*, the others in the manner shown in FIG. 1*b*.

The adhesive, as applied, was a 16% solution in methanol of a 1:2 mixture of a phenolic resole, having a phenol:formaldehyde molar ratio of 1:1.43, and a poly(vinyl butyral) of average molecular weight 41,000. The adhesive was dried in air at room temperature, leaving 22 g/sq.meter of adhesive in the lines.

Figure 2:
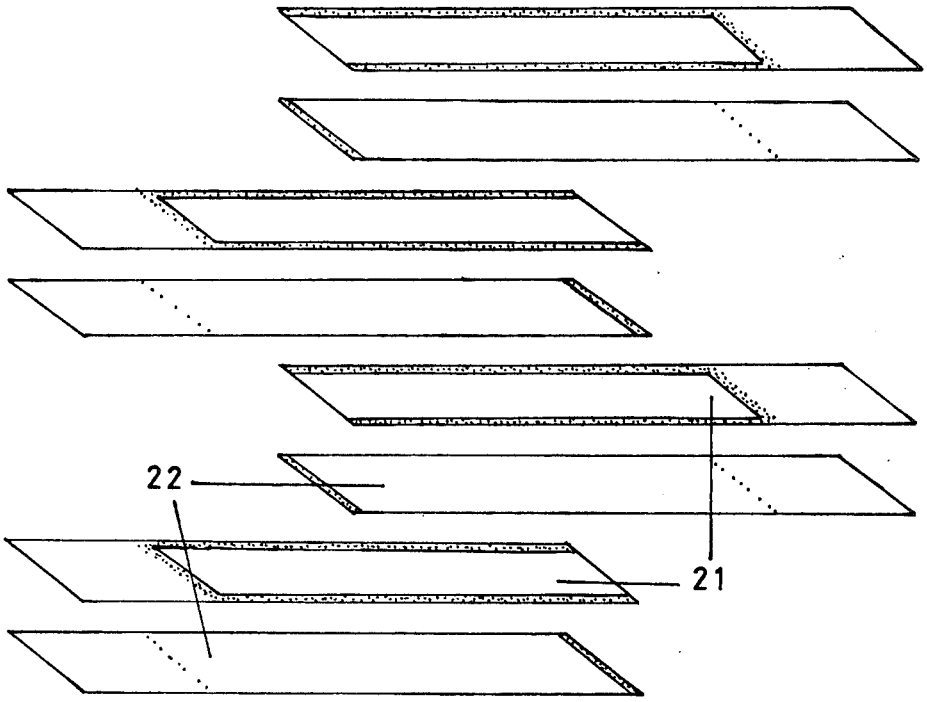
Figure 3:
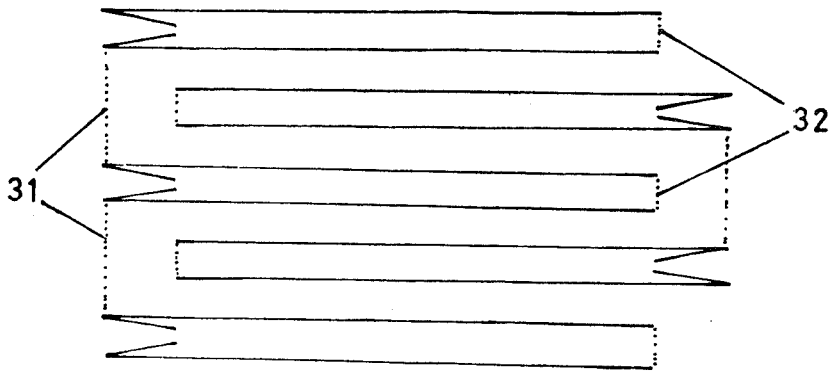
FIG. 3 shows a side elevation of an exploded stack of strips in which the strips have been folded prior to pressing. The broken lines 31 and 32 link two surfaces which are to be bonded together.
Figure 4:
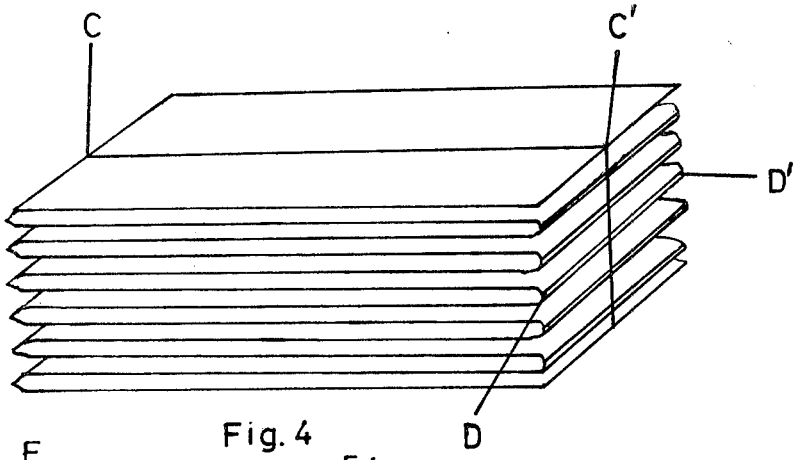
FIG. 4 shows a perspective view of an uninflated compressed stack. Prior to inflation this stack may be cut to reduce the number of channels in each pass, such as along a line CC′, and may be cut, e.g. along a line DD′, to reduce the height of the heat exchanger.

The strips were stacked in the staggered arrangement shown in FIG. 2, the ends of the strips being folded as shown in FIG. 3. The folded stack was placed in a press and subjected to a pressure of 2.1 meganewtons sq. meter and heated at 150° C for 30 minutes to cure the adhesive. The stack was inflated with air at 70 kilonewtons sq. meter to form a single channel heat exchanger core.

I claim:

1. A method of making a heat exchanger consisting of a conduit having a plurality of passes joined by integral return bends which comprises i. stacking at least three pairs of oblong strips of material together so that alternate pairs of strips overhang the stack along one of the shorter edges thereof and the remaining alternate pairs of strips overhang the stack along the other of the shorter edges thereof, ii. bonding the individual strips of each pair together along the shorter edge which does not overhang the stack, bonding the adjacent strips of adjacent pairs along both longer edges of said strips and bonding the adjacent overhang areas of said alternate pairs of strips along the three peripheral edges of said overhang, thereby forming a flat, serpentine conduit, and iii. inflating the conduit by applying internally a fluid under pressure.

2. Method according to claim 1, in which the strips are of metal.

3. Method according to claim 2, in which the strips are of aluminum or aluminum alloy.

4. Method according to claim 1, in which the strips are from 0.01 to 0.8 mm thick.

5. Method according to claim 1, in which the passes in the inflated conduit are parallel.

6. Method according to claim 1, in which the strips are bonded together by means of an adhesive.

7. Method according to claim 6, in which the adhesive is a thermosetting resin adhesive composition.

8. Method according to claim 1, in which metallic strips are bonded together by welding, soldering, or brazing.

9. Method according to claim 1, in which packing pieces, each twice the thickness of the strips, are inserted between each pair of passes in the rea of the return bends and pressure is applied to assist the bonding of adjacent strips together to form the conduit.

10. Method according to claim 9, in which the packing pieces are provided by excess material at the end of each strip which is folded over prior to being stacked.

11. Method according to claim 1, in which the conduit has two or more separate channels.

12. Method according to claim 1, in which the conduit has two or more interconnecting channels.

13. Method according to claim 1, in which shaped tool pieces are inserted between layers of conduit, and the stack is constrained within a frame and fitted between tie bars before the conduit is inflated.

14. Method according to claim 1, in which finning pieces are inserted between passes of conduit before or after inflation.

* * * * *